US009803428B2

(12) United States Patent
Matthews, III

(10) Patent No.: US 9,803,428 B2
(45) Date of Patent: Oct. 31, 2017

(54) EARTH-BORING TOOLS AND COMPONENTS THEREOF INCLUDING METHODS OF ATTACHING A NOZZLE TO A BODY OF AN EARTH-BORING TOOL AND TOOLS AND COMPONENTS FORMED BY SUCH METHODS

(71) Applicant: Baker Hughes Incorporated, Houston, TX (US)

(72) Inventor: Oliver Matthews, III, Spring, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 238 days.

(21) Appl. No.: 14/636,362

(22) Filed: Mar. 3, 2015

(65) Prior Publication Data

US 2015/0167397 A1 Jun. 18, 2015

Related U.S. Application Data

(62) Division of application No. 13/776,222, filed on Feb. 25, 2013, now Pat. No. 8,973,466, which is a division (Continued)

(51) Int. Cl.

*E21B 10/61* (2006.01)
*E21B 10/00* (2006.01)

(Continued)

(52) U.S. Cl.

CPC ..... *E21B 10/61* (2013.01); *E21B 10/00* (2013.01); *E21B 10/42* (2013.01); *E21B 2010/607* (2013.01); *Y10T 29/49826* (2015.01)

(58) Field of Classification Search

CPC ..... E21B 10/60; E21B 10/61; E21B 10/00; E21B 10/42; E21B 2010/607; Y10T 29/49826

See application file for complete search history.

(56) References Cited

U.S. PATENT DOCUMENTS 2,145,168 A 1/1939 Flagg
2,408,892 A * 10/1946 Stokes ..... E21B 10/18 175/315

(Continued)

FOREIGN PATENT DOCUMENTS

WO 2008057489 A1 5/2008

OTHER PUBLICATIONS

International Search Report for International Application No. PCT/US2010/031825, mailed Nov. 30, 2010, 5 pages.

(Continued)

*Primary Examiner* — Yong-Suk (Philip) Ro
(74) *Attorney, Agent, or Firm* — TraskBritt

(57) ABSTRACT

Earth-boring drill bits include a bit body, an element having an attachment feature bonded to the bit body, and a shank assembly. Methods for assembling an earth-boring rotary drill bit include bonding a threaded element to the bit body of a drill bit and engaging the shank assembly to the threaded element. A nozzle assembly for an earth-boring rotary drill bit may include a cylindrical sleeve having a threaded surface and a threaded nozzle disposed at least partially in the cylindrical sleeve and engaged therewith. Methods of forming an earth-boring drill bit include providing a nozzle assembly including a tubular sleeve and nozzle at least partially within a nozzle port of a bit body.

17 Claims, 10 Drawing Sheets

Related U.S. Application Data of application No. 12/429,059, filed on Apr. 23, 2009, now Pat. No. 8,381,844.

(51) Int. Cl.
*E21B 10/42* (2006.01)
*E21B 10/60* (2006.01)

(56) References Cited

U.S. PATENT DOCUMENTS

| | | | |
|---|---|---|---|
| 3,823,789 | A | 7/1974 | Garner |
| 3,945,446 | A | 3/1976 | Ostertag et al. |
| 4,542,798 | A | 9/1985 | Madigan |
| 5,441,121 | A | 8/1995 | Tibbitts |
| 5,829,539 | A | 11/1998 | Newton et al. |
| 5,927,410 | A | 7/1999 | Greer et al. |
| 6,102,142 | A | 8/2000 | Besson et al. |
| 6,138,780 | A | 10/2000 | Beuershausen |
| 6,142,248 | A | 11/2000 | Thigpen et al. |
| 7,776,256 | B2 | 8/2010 | Smith et al. |
| 7,784,567 | B2 | 8/2010 | Choe et al. |
| 7,802,495 | B2 | 9/2010 | Oxford et al. |
| 7,913,779 | B2 | 3/2011 | Choe et al. |
| 7,954,568 | B2 | 6/2011 | Bilen |
| 8,261,632 | B2 | 9/2012 | Stevens |
| 8,381,844 | B2 | 2/2013 | Matthews, III et al. |
| 2005/0211475 | A1 | 9/2005 | Mirchandani et al. |
| 2005/0247491 | A1 | 11/2005 | Mirchandani et al. |
| 2006/0118298 | A1 | 6/2006 | Millar et al. |
| 2006/0266557 | A1 | 11/2006 | Estes |
| 2007/0056776 | A1 | 3/2007 | Overstreet |
| 2007/0056777 | A1 | 3/2007 | Overstreet |
| 2007/0102198 | A1 | 5/2007 | Oxford et al. |
| 2007/0102199 | A1 | 5/2007 | Smith et al. |
| 2007/0102200 | A1 | 5/2007 | Choe et al. |
| 2007/0102202 | A1 | 5/2007 | Choe et al. |
| 2007/0107942 | A1 | 5/2007 | Overstreet et al. |
| 2007/0256862 | A1 | 11/2007 | Lund et al. |
| 2008/0011519 | A1 | 1/2008 | Smith et al. |
| 2008/0029310 | A1 | 2/2008 | Stevens et al. |
| 2008/0066970 | A1 | 3/2008 | Zahradnik et al. |
| 2008/0101977 | A1 | 5/2008 | Eason et al. |
| 2008/0110680 | A1 | 5/2008 | Bilen |
| 2008/0128176 | A1 | 6/2008 | Choe et al. |
| 2008/0135304 | A1 | 6/2008 | Duggan et al. |
| 2008/0135305 | A1 | 6/2008 | Smith et al. |
| 2008/0156148 | A1 | 7/2008 | Smith et al. |
| 2008/0163723 | A1 | 7/2008 | Mirchandani et al. |
| 2008/0202814 | A1 | 8/2008 | Lyons et al. |
| 2008/0202820 | A1 | 8/2008 | Eason et al. |
| 2008/0223622 | A1 | 9/2008 | Duggan et al. |
| 2008/0236899 | A1* | 10/2008 | Oxford ..... E21B 10/18 175/339 |
| 2008/0302576 | A1 | 12/2008 | Mirchandani et al. |
| 2009/0020334 | A1 | 1/2009 | Gavia |
| 2009/0031863 | A1 | 2/2009 | Lyons et al. |
| 2009/0032310 | A1 | 2/2009 | Stevens et al. |
| 2009/0032571 | A1 | 2/2009 | Smith |
| 2009/0044663 | A1 | 2/2009 | Stevens et al. |
| 2009/0205870 | A1 | 8/2009 | Smith |
| 2009/0301787 | A1 | 12/2009 | Smith et al. |
| 2010/0270086 | A1 | 10/2010 | Matthews, III et al. |
| 2013/0160611 | A1 | 6/2013 | Matthews, III et al. |

OTHER PUBLICATIONS

International Written Opinion for International Application No. PCT/US2010/031825, mailed Nov. 30, 2010, 6 pages.

International Preliminary Report on Patentability for International Application No. PCT/US2010/031825 dated Oct. 25, 2011, 8 pages.

* cited by examiner

EARTH-BORING TOOLS AND COMPONENTS THEREOF INCLUDING METHODS OF ATTACHING A NOZZLE TO A BODY OF AN EARTH-BORING TOOL AND TOOLS AND COMPONENTS FORMED BY SUCH METHODS

CROSS-REFERENCE TO RELATED APPLICATIONS

This application is a divisional of U.S. patent application Ser. No. 13/776,222, filed Feb. 25, 2013, now U.S. Pat. No. 8,973,466, issued Mar. 10, 2015 which is a divisional of U.S. patent application Ser. No. 12/429,059, filed Apr. 23, 2009, now U.S. Pat. No. 8,381,844, issued Feb. 26, 2013, the disclosure of each of which is hereby incorporated herein by this reference in its entirety.

TECHNICAL FIELD

The present invention generally relates to earth-boring drill bits and other tools that may be used to drill subterranean formations and to methods of manufacturing such drill bits and tools. More particularly, the present invention relates to apparatus and methods for attaching components to a body of a drill bit or other tool.

BACKGROUND

Rotary drill bits are commonly used for drilling wellbores in earth formations. One type of rotary drill bit is the fixed-cutter bit (often referred to as a "drag bit"), which typically includes a plurality of cutting elements secured to a face region of a bit body. The bit body of a rotary drill bit may be formed from steel. Alternatively, a bit body may be fabricated to comprise a composite material. A so-called "infiltration" bit includes a bit body comprising a particle-matrix composite material and is fabricated in a mold using an infiltration process. Recently, pressing and sintering processes have been used to form bit bodies of drill bits and other tools comprising particle-matrix composite materials. Such pressed and sintered bit bodies may be fabricated by pressing (e.g., compacting) and sintering a powder mixture that includes hard particles (e.g., tungsten carbide) and particles of a metal matrix material (e.g., a cobalt-based alloy, an iron-based alloy, or a nickel-based alloy).

A conventional earth-boring rotary drill bit 10 is shown in FIG. 1 that includes a bit body 12 comprising a particle-matrix composite material 15. The bit body 12 is secured to a steel shank 20 having a threaded connection portion 28 (e.g., an American Petroleum Institute (API) threaded connection portion) for attaching the drill bit 10 to a drill string (not shown). The bit body 12 includes a crown 14 and a steel blank 16. The steel blank 16 is partially embedded in the crown 14. The crown 14 includes a particle-matrix composite material 15, such as, for example, particles of tungsten carbide embedded in a copper alloy matrix material. The bit body 12 is secured to the steel shank 20 by way of a threaded connection 22 and a weld 24 extending around the drill bit 10 on an exterior surface thereof along an interface between the bit body 12 and the steel shank 20.

The bit body 12 further includes wings or blades 30 that are separated by junk slots 32. Internal fluid passageways (not shown) extend between the face 18 of the bit body 12 and a longitudinal bore 40, which extends through the steel shank 20 and partially through the bit body 12. Nozzle assemblies 42 also may be provided at the face 18 of the bit body 12 within the internal fluid passageways.

A plurality of cutting elements 34 is attached to the face 18 of the bit body 12. Generally, the cutting elements 34 of a fixed-cutter type drill bit have either a disk shape or a substantially cylindrical shape. A cutting surface 35 comprising a hard, super-abrasive material, such as polycrystalline diamond, may be provided on a substantially circular end surface of each cutting element 34. Such cutting elements 34 are often referred to as "polycrystalline diamond compact" (PDC) cutting elements 34. The PDC cutting elements 34 may be provided along the blades 30 within pockets 36 formed in the face 18 of the bit body 12, and may be supported from behind by buttresses 38, which may be integrally formed with the crown 14 of the bit body 12. Typically, the cutting elements 34 are fabricated separately from the bit body 12 and secured within the pockets 36 formed in the outer surface of the bit body 12. A bonding material such as an adhesive or, more typically, a metal alloy braze material may be used to secure the cutting elements 34 to the bit body 12.

During drilling operations, the drill bit 10 is secured to the end of a drill string, which includes tubular pipe and equipment segments coupled end-to-end between the drill bit 10 and other drilling equipment at the surface. The drill bit 10 is positioned at the bottom of a wellbore such that the cutting elements 34 are adjacent the earth formation to be drilled. Equipment such as a rotary table or top drive may be used for rotating the drill string and the drill bit 10 within the borehole. Alternatively, the shank 20 of the drill bit 10 may be coupled directly to a drive shaft of a downhole motor, which then may be used to rotate the drill bit 10. As the drill bit 10 is rotated, drilling fluid is pumped to the face 18 of the bit body 12 through the longitudinal bore 40 and the internal fluid passageways (not shown). Rotation of the drill bit 10 under weight applied through the drill string causes the cutting elements 34 to scrape across and shear away the surface of the underlying formation. The formation cuttings mix with and are suspended within the drilling fluid and pass through the junk slots 32 and the annular space between the wellbore and the drill string to the surface of the earth formation.

Conventionally, bit bodies that include a particle-matrix composite material 15, such as the previously described bit body 12, have been fabricated in graphite molds using the so-called "infiltration" process. The cavities of the graphite molds are conventionally machined with a multi-axis machine tool. Fine features are then added to the cavity of the graphite mold using hand-held tools. Additional clay work also may be required to obtain the desired configuration of some features of the bit body. Where necessary, preform elements or displacements (which may comprise ceramic components, graphite components, or resin-coated sand compact components) may be positioned within the mold and used to define the internal passages, cutting element pockets 36, junk slots 32, and other external topographic features of the bit body 12. The cavity of the graphite mold is filled with hard particulate carbide material (such as tungsten carbide, titanium carbide, tantalum carbide, etc.). The preformed steel blank 16 may then be positioned in the mold at the appropriate location and orientation. The steel blank 16 typically is at least partially submerged in the particulate carbide material within the mold.

The mold then may be vibrated or the particles otherwise packed to decrease the amount of space between adjacent particles of the particulate carbide material. A matrix material (often referred to as a "binder" material), such as a copper-based alloy, may be melted, and caused or allowed to infiltrate the particulate carbide material within the mold cavity. The mold and bit body 12 are allowed to cool to solidify the matrix material. The steel blank 16 is bonded to the particle-matrix composite material 15 forming the crown 14 upon cooling of the bit body 12 and solidification of the matrix material. Once the bit body 12 has cooled, the bit body 12 is removed from the mold and any displacements are removed from the bit body 12. Destruction of the graphite mold typically is required to remove the bit body 12 therefrom.

After the bit body 12 has been formed, PDC cutting elements 34 may be bonded to the face 18 of the bit body 12 by, for example, brazing, mechanical, or adhesive affixation. Alternatively, the cutting elements 34 may be bonded to the face 18 of the bit body 12 during furnacing of the bit body if thermally stable synthetic diamonds, or natural diamonds, are employed in the cutting elements 34. Of course, more than one type of cutting element may be employed, as is known to those of ordinary skill in the art.

The bit body 12 may be secured to the steel shank 20. As the particle-matrix composite materials 15 typically used to form the crown 14 are relatively hard and not easily machined, the steel blank 16 is used to secure the bit body 12 to the shank 20. Complementary threads may be machined on exposed surfaces of the steel blank 16 and the shank 20 to provide the threaded connection 22 therebetween. The steel shank 20 may be threaded onto the bit body 12, and the weld 24 then may be provided along the interface between the steel blank 16 and the steel shank 20.

As discussed above, nozzle assemblies 42 also may be provided at the face 18 of the bit body 12. Nozzle assemblies 42 allow fluid flow areas to be specified or selected to obtain various flow rates and patterns. During drilling, drilling fluid is discharged through nozzle assemblies 42 located in nozzle ports in fluid communication with the face 18 of bit body 12 for cooling the cutting surface 35 of cutting elements 34 and removing formation cuttings from the face 18 of drill bit 10 into passages such as junk slots 32. As shown in FIG. 2 of the drawings, a conventional earth-boring rotary drill bit 10 for use in subterranean drilling may include a plurality of nozzle assemblies, exemplified by illustrated nozzle assembly 42. While many conventional drill bits use a single piece nozzle, the nozzle assembly 42 is a two piece replaceable nozzle assembly, the first piece being a tubular tungsten carbide inlet tube 50 that fits into a port or passage 54 formed in the body 12 of the drill bit 10, and is seated upon an annular shoulder 56 of passage 54. The second piece is a tungsten carbide nozzle 52 that may have a restricted bore 64 that is secured within passage 54 of the drill bit 10 by threads that engage mating threads 58 on the wall of passage 54. The inlet tube 50 is retained in passage 54 by abutment between the annular shoulder 56 and the interior end of the nozzle 52. The inlet tube 50 and the nozzle 52 are used to provide protection to the material of the drill bit 10 through which passage 54 extends against erosive drilling fluid effects by providing a hard, abrasion- and erosion-resistant pathway from a fluid passageway 68 within the bit body to a nozzle exit 60 located proximate to an exterior surface of the bit body. The inlet tube 50 and nozzle 52 are replaceable should the drilling fluid erode or wear the parts within internal passage 62 extending through these components, or when a nozzle 52 having a different orifice size is desired. The outer surface or wall of the nozzle 52 is in sealing contact with a compressed O-ring 66 disposed in an annular groove formed in the wall of passage 54 to provide a fluid seal between the bit body 12 and the nozzle 52.

BRIEF SUMMARY

In one embodiment, the present invention includes an earth-boring rotary drill bit comprising a bit body having at least one cavity and an insert bonded to the bit body with a bonding material. The insert includes at least one attachment feature and is at least partially disposed within the cavity of the bit body. Further, a shank assembly comprising at least one complimentary engagement feature is engaged with the at least one engagement feature of the insert. Mechanical interference between the at least one engagement feature of the insert and the at least one engagement feature of the shank assembly at least partially secures the shank assembly to the bit body.

In another embodiment, the present invention includes an earth-boring rotary drill bit having a substantially annular shaped threaded element fixedly coupled to the bit body with a bonding material. The threaded element includes a threaded surface covering a substantial portion of at least one of an outer surface of the threaded element and an inner surface of the threaded element. The drill bit may also include a shank assembly having a complementary threaded surface complementary to the threaded surface of the threaded element. The complementary threaded surface of the shank assembly is coaxially engaged with the bit body at the threaded element.

In yet another embodiment, the present invention includes a method of forming an earth-boring rotary drill bit in which a threaded element is bonded to a solidified bit body and a shank assembly is threaded to the threaded element.

In yet an additional embodiment, the present invention includes a nozzle assembly for a drill bit for subterranean drilling comprising a cylindrical sleeve and a nozzle. The cylindrical sleeve has a threaded inner surface, an outer surface, a first longitudinal end, and a second, opposite longitudinal end. The cylindrical sleeve may comprise a plurality of slots extending from the first longitudinal end toward the second longitudinal end. The plurality of slots defines a plurality of flexible fingers therebetween. Further, the nozzle has a threaded outer surface configured to engage the threaded inner surface of the cylindrical sleeve.

In yet an additional embodiment, the present invention includes an earth-boring drill bit comprising a bit body, a cylindrical sleeve, and a nozzle. The bit body has at least one nozzle port formed in the bit body. The cylindrical sleeve is disposed within the nozzle port of the bit body and includes a threaded inner surface, an outer surface, a first longitudinal end, and a second, opposite longitudinal end. The cylindrical sleeve may comprise a plurality of slots extending from the first longitudinal end toward the second longitudinal end. The plurality of slots defines a plurality of flexible fingers therebetween. Further, the nozzle may be disposed at least partially within the cylindrical sleeve and include a threaded outer surface engaged with the threaded inner surface of the cylindrical sleeve.

In yet an additional embodiment, a method of forming an earth-boring drill bit includes forming a tubular sleeve having a plurality of flexible portions. The tubular sleeve is disposed in a nozzle port of a bit body of an earth-boring drill bit, and a nozzle is inserted at least partially within the sleeve. The nozzle port and the sleeve are configured to provide mechanical interference between the sleeve and a surface of the bit body within the nozzle port to retain the sleeve in the bit body.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the following description of embodiments of the invention when read in conjunction with the accompanying drawings in which:

DETAILED DESCRIPTION

The illustrations presented herein are not meant to be actual views of any particular material, apparatus, system, or method, but are merely idealized representations which are employed to describe embodiments of the present invention. Additionally, elements common between figures may retain the same numerical designation for convenience and clarity.

Figure 1:
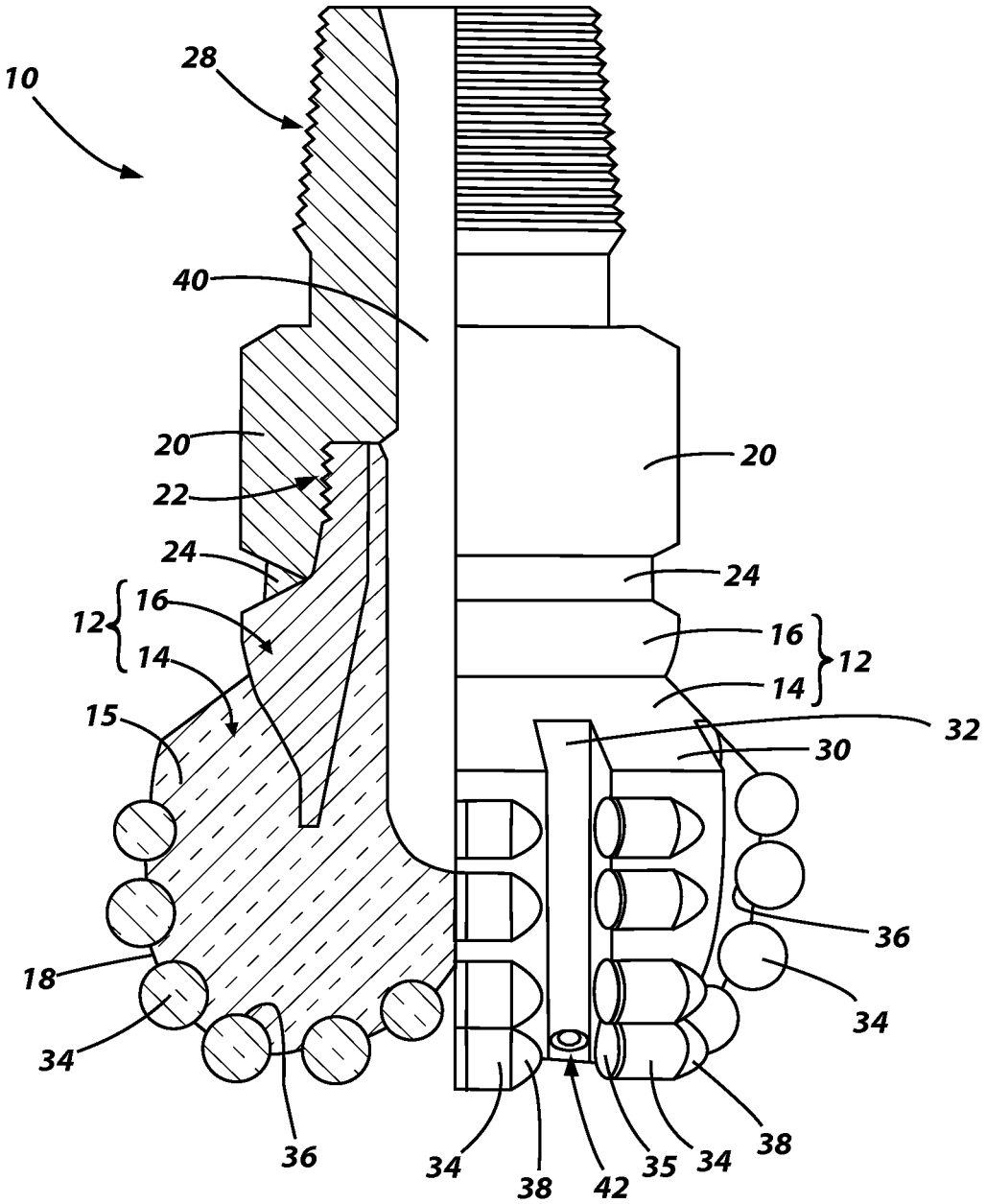
FIG. 1 Prior Art
FIG. 1 is a partial longitudinal cross-sectional view of a conventional earth-boring rotary drill bit that has a bit body that includes a particle-matrix composite material and that is formed using an infiltration process.
Figure 2:
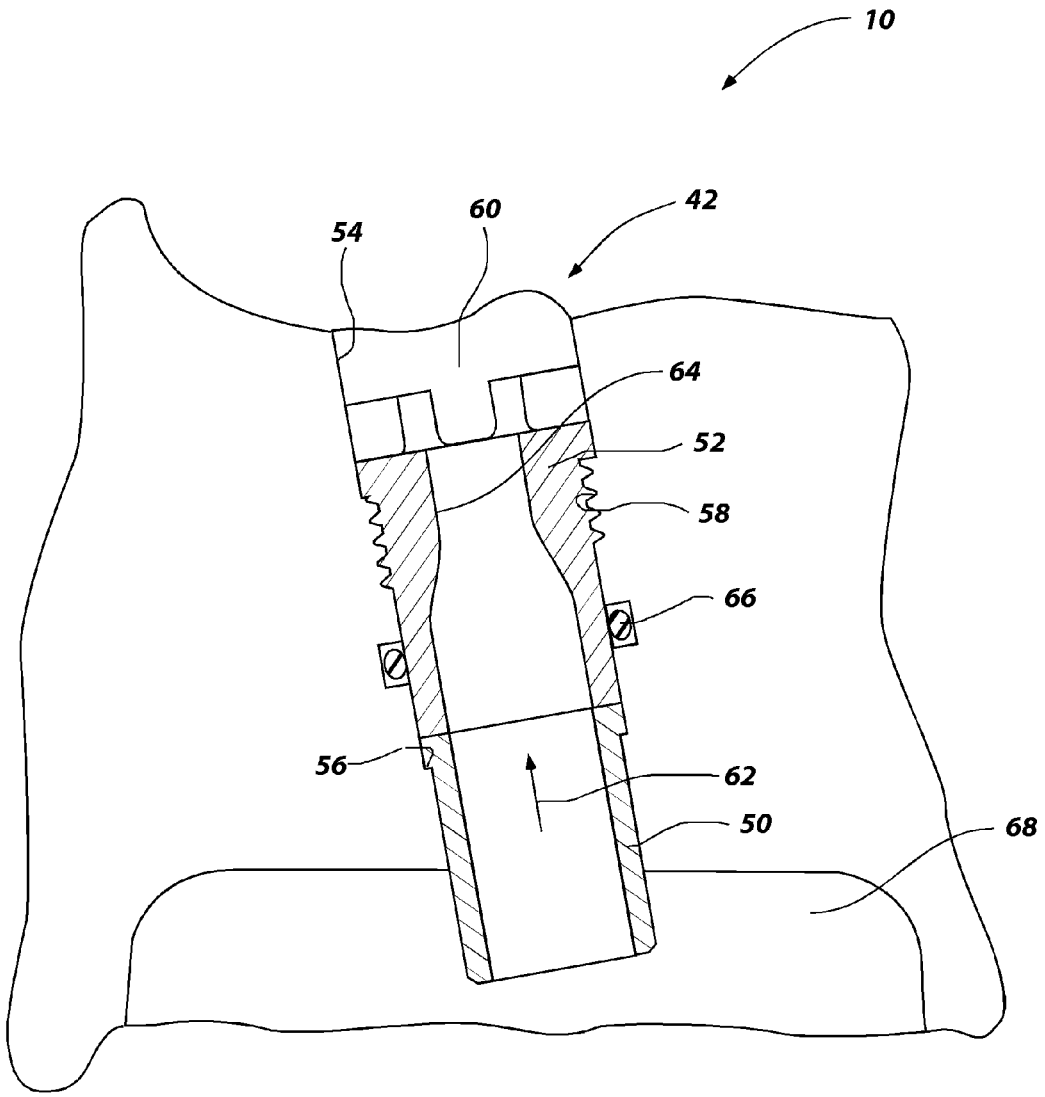
FIG. 2 Prior Art
FIG. 2 shows a nozzle assembly that may be secured within a body of a drill bit.
Figure 3:
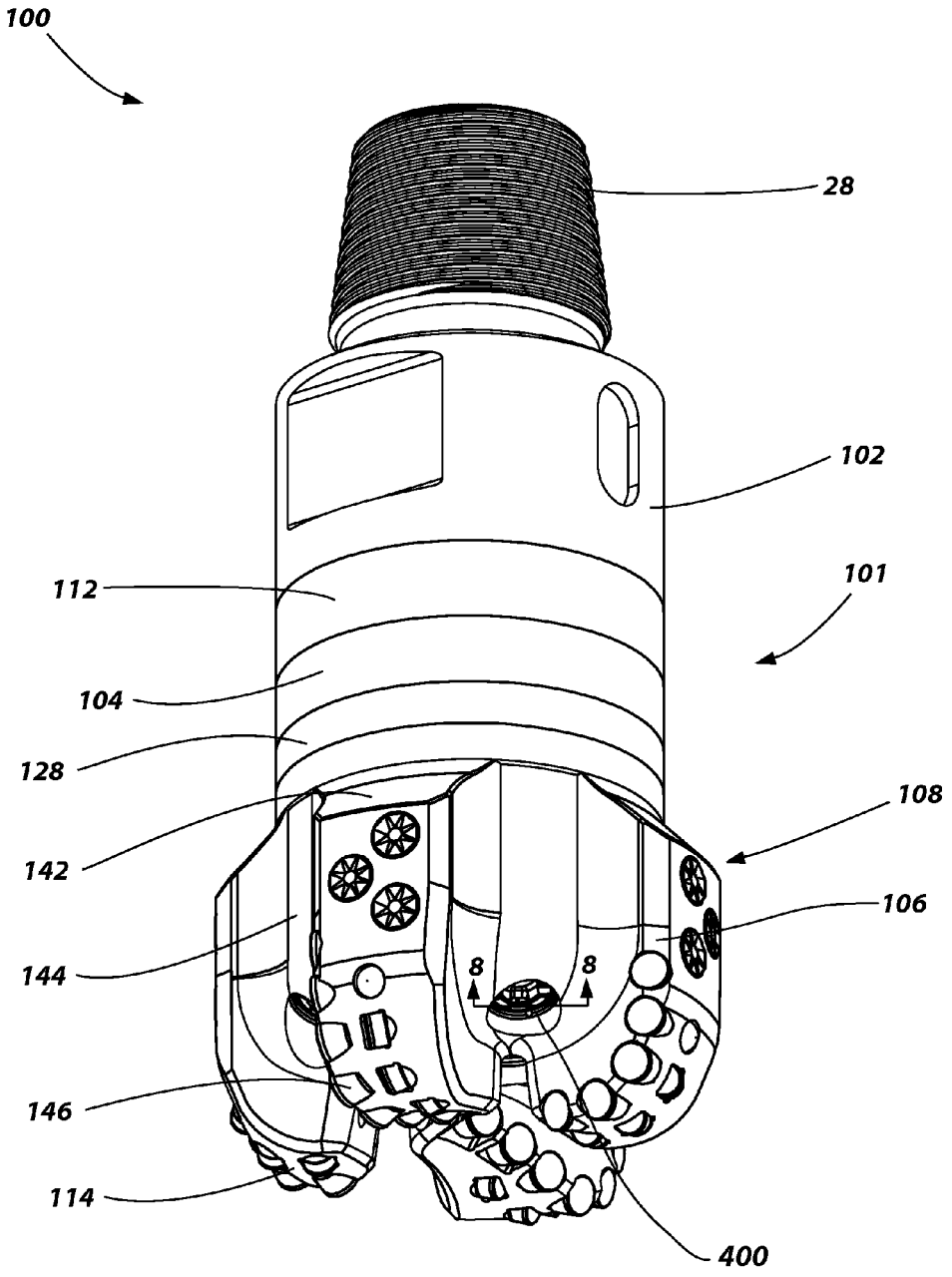
FIG. 3 is a perspective view of one embodiment of an earth-boring rotary drill bit of the present invention that includes a shank assembly attached to a portion of a bit body of the drill bit using a threaded element.
Figure 4:
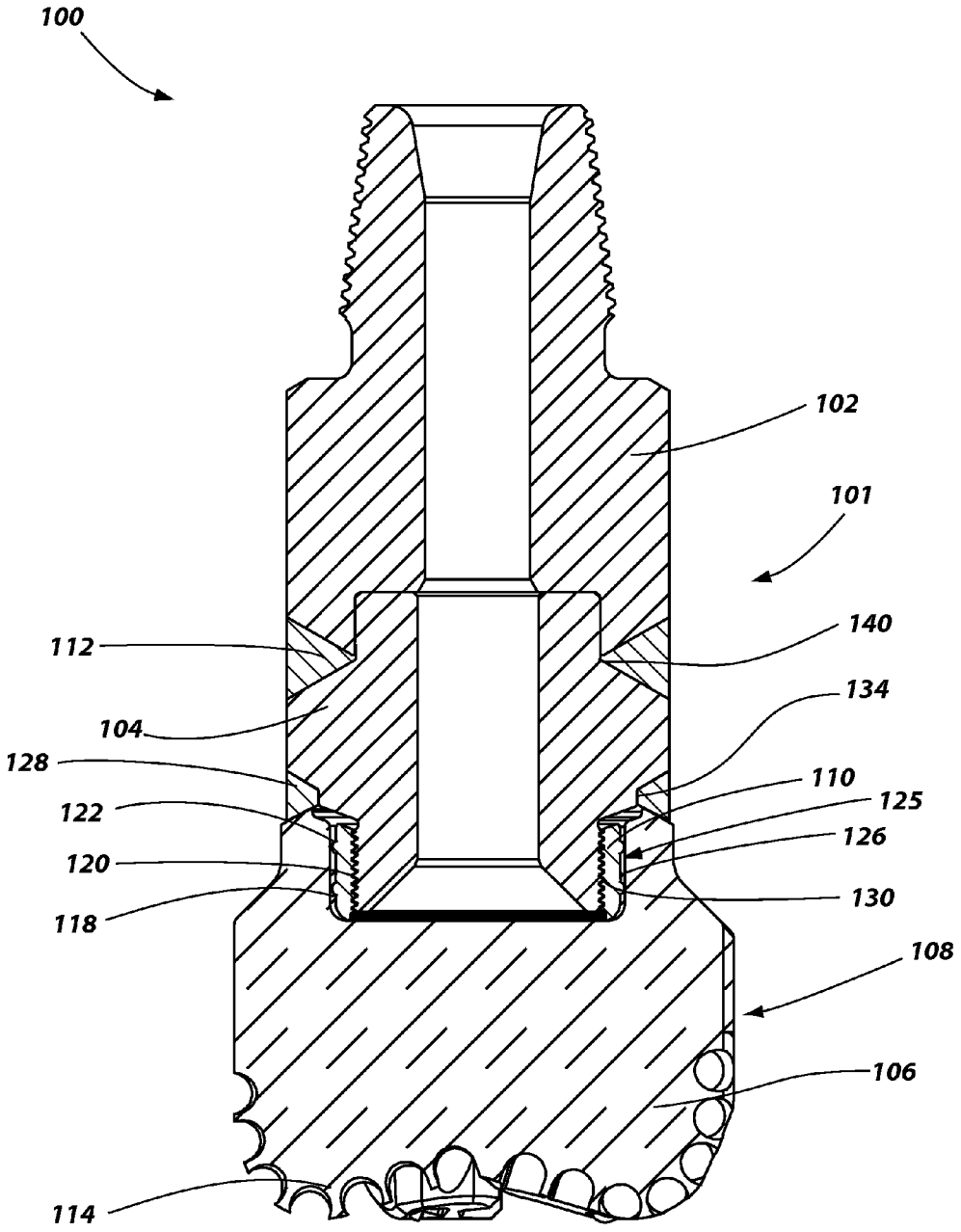
FIG. 4 is a longitudinal cross-sectional view of the earth-boring rotary drill bit shown in FIG. 3.

An embodiment of an earth-boring rotary drill bit 100 of the present invention is shown in a perspective view in FIG. 3, and in a longitudinal cross-sectional view in FIG. 4. As shown in FIG. 4, the earth-boring rotary drill bit 100 may not include a metal blank, such as the steel blank 16 of the drill bit 10 (FIG. 1). In contrast, a shank assembly 101, which includes a shank 102 secured to an extension 104, may be secured to a particle-matrix composite material 106 of a bit body 108 by use of a element or insert having an engagement feature such as a threaded element 110 having a threaded surface. As used herein, the term "shank assembly" means any structure or assembly that is or may be attached directly to a bit body of an earth-boring rotary drill bit and that includes a threaded connection configured for coupling the structure or assembly, and the bit body attached thereto, to a drill string. Shank assemblies include, for example, a shank secured to an extension member, such as the shank 102 and the extension 104 of the earth-boring rotary drill bit 100, as well as a shank that is used without an extension member, as described below in reference to an earth-boring rotary drill bit 300 shown in FIG. 7.

Referring now to FIGS. 3 and 4, the shank 102 may include a connection portion 28 (e.g., an American Petroleum Institute (API) threaded connection portion) and may be at least partially secured to the extension 104 by a weld 112 extending at least partially around the drill bit 100 on an exterior surface thereof along an interface between the shank 102 and the extension 104 in a concentric channel 140 (e.g., a weld groove). By way of example and not limitation, both the shank 102 and the extension 104 may each be formed from steel, another iron-based alloy, or any other metal alloy or material that exhibits acceptable physical properties.

In some embodiments, the bit body 108 may comprise a particle-matrix composite material 106 formed by way of non-limiting example and as noted above, by pressing and sintering. For example, the bit body 108 may predominantly comprise a particle-matrix composite material. By way of example and not limitation, the particle-matrix composite material 106 may comprise a plurality of hard particles dispersed throughout a matrix material. In some embodiments, the hard particles may comprise a material selected from diamond, boron carbide, boron nitride, silicon nitride, aluminum nitride, and carbides or borides of the group consisting of W, Ti, Mo, Nb, V, Hf, Zr, Si, Ta, and Cr, and the matrix material may be selected from the group consisting of iron-based alloys, nickel-based alloys, cobalt-based alloys, titanium-based alloys, aluminum-based alloys, iron and nickel-based alloys, iron and cobalt-based alloys, and nickel and cobalt-based alloys. As used herein, the term "[metal]-based alloy" (where [metal] is any metal) means commercially pure [metal] in addition to metal alloys wherein the weight percentage of [metal] in the alloy is greater than or equal to the weight percentage of all other components of the alloy individually.

Referring again to FIG. 3, in some embodiments, the bit body 108 may include a plurality of blades 142 separated by junk slots 144 (similar to the blades 30 and the junk slots 32 shown in FIG. 1). A plurality of cutting elements 146 (similar to the cutting elements 34 shown in FIG. 1, which may include, for example, PDC cutting elements) may be mounted on a face 114 of the bit body 108 along each of the blades 142.

Figure 5:
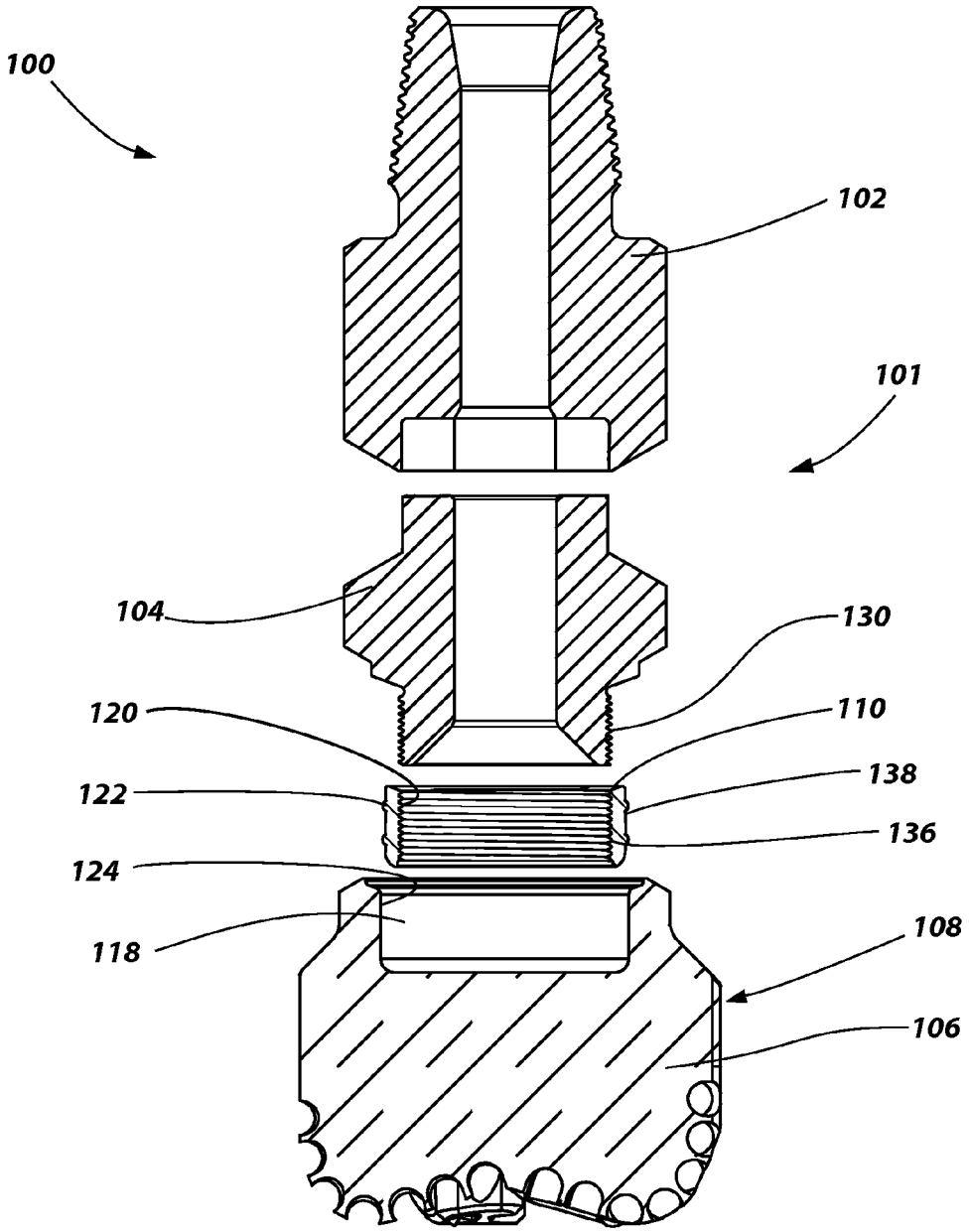
FIG. 5 is an exploded longitudinal cross-sectional view of the earth-boring rotary drill bit shown in FIG. 3
Figure 5A:
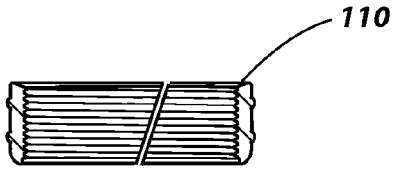
FIG. 5A shows a threaded element in accordance with another embodiment of the present disclosure.

FIG. 5 is an exploded longitudinal cross-sectional view of the earth-boring rotary drill bit 100 shown in FIGS. 3 and 4. Referring to FIG. 5, the bit body 108 may contain a feature on the upper portion of the bit body 108 such as a cavity 118, which is configured to receive the threaded element 110 such as a threaded insert. The threaded element 110 may have, for example, a substantially annular shape and an engagement feature such as a threaded surface 120. The threaded element 110 may have an inner surface 136 and an outer surface 138. In some embodiments, the outer surface 138 may comprise a generally smooth, non-threaded cylindrical surface 122 and the inner surface 136 may comprise a threaded surface 120. While the embodiment shown and described with reference to FIGS. 4 and 5 is directed toward providing a feature on the bit body 108 such as a cavity 118 to receive a threaded element 110, additional embodiments of the present invention may include additional orientations of the threaded surface 120 of the threaded element 110 and different features of the bit body 108 including, but not limited to, a feature such as a protrusion configured to receive the threaded element 110. In some embodiments, the threaded element 110 may comprise a substantially solid, cylindrical ring structure. In additional embodiments, the threaded element 110 may comprise a split ring as shown in FIG. 5A. In such embodiments, the split ring may have an outer diameter in a relaxed state that is larger than an inner diameter of the cavity 118, such that the split ring must be compressed to insert the split ring into the cavity 118.

Referring to FIGS. 4 and 5, the cavity 118 may be fabricated such that the threaded element 110 may be at least partially disposed within the cavity 118. A surface of the threaded element 110, such as the generally smooth cylindrical surface 122, may be disposed proximate (e.g., adjacent) a generally smooth, non-threaded cylindrical inner wall 124 of the bit body 108 within the cavity 118. In additional embodiments, the surface 122 of the threaded element 110 may be tapered, and the adjacent inner wall 124 of the bit body 108 within the cavity 118 may comprise a complementary tapered surface. The taper may be configured and oriented such that mechanical interference between the threaded element 110 and the bit body 108 at the interface between the abutting tapered surfaces aids in preventing removal of the threaded element 110 from the cavity 118.

The threaded element 110 may be coupled to the bit body 108 using a bonding material such as an adhesive or a metal alloy braze material. In additional embodiments, the threaded element 110 may be welded to the bit body 108. As a non-limiting example, a braze alloy 126 may be provided between the threaded element 110 and the cavity 118 to at least partially secure the threaded element 110 to the bit body 118 within the cavity 118 therein.

Figure 6:
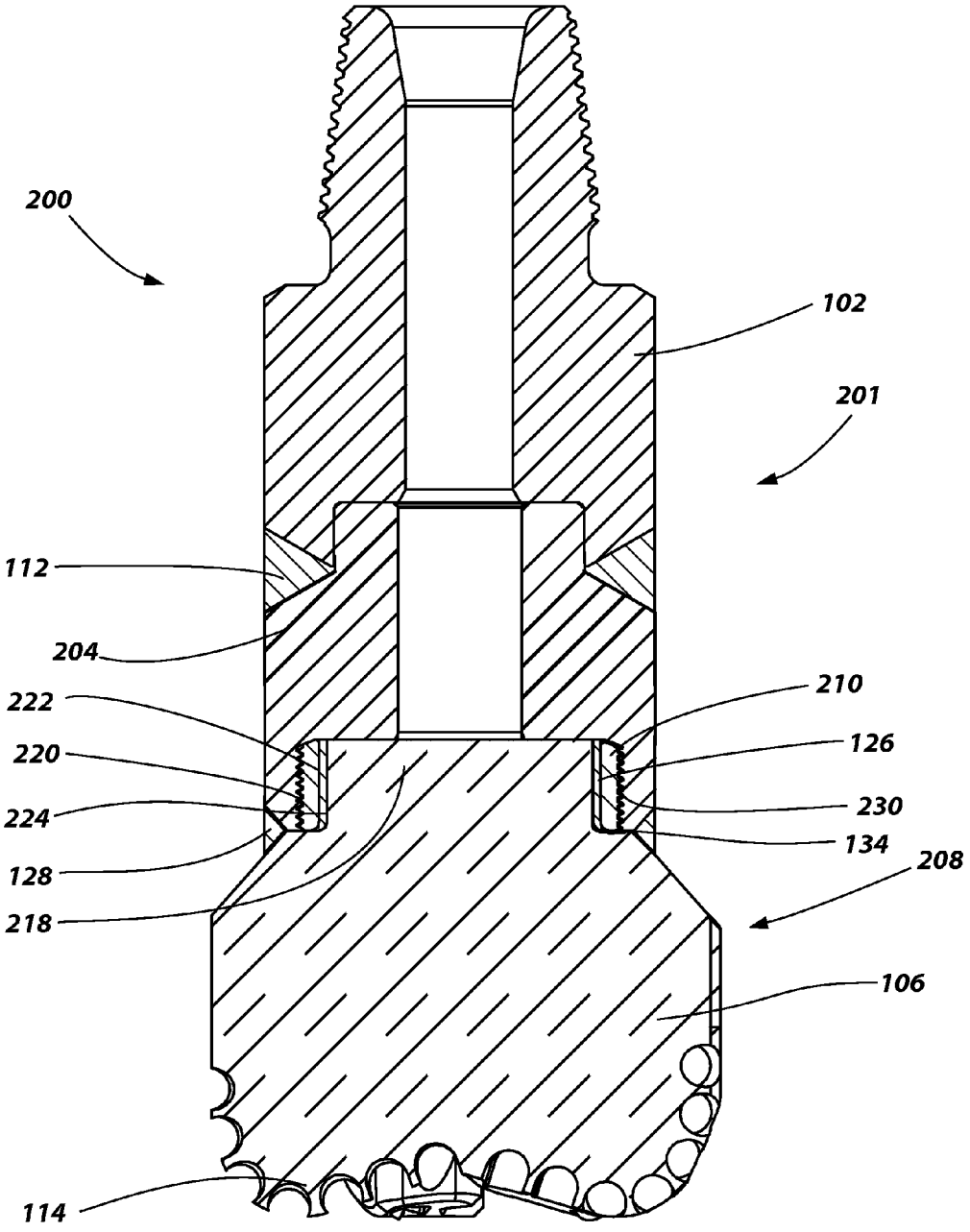
FIG. 6 is a longitudinal cross-sectional view of another embodiment of an earth-boring rotary drill bit of the present invention that includes a shank assembly secured to a portion of a bit body of the drill bit using a threaded element.
Figure 7:
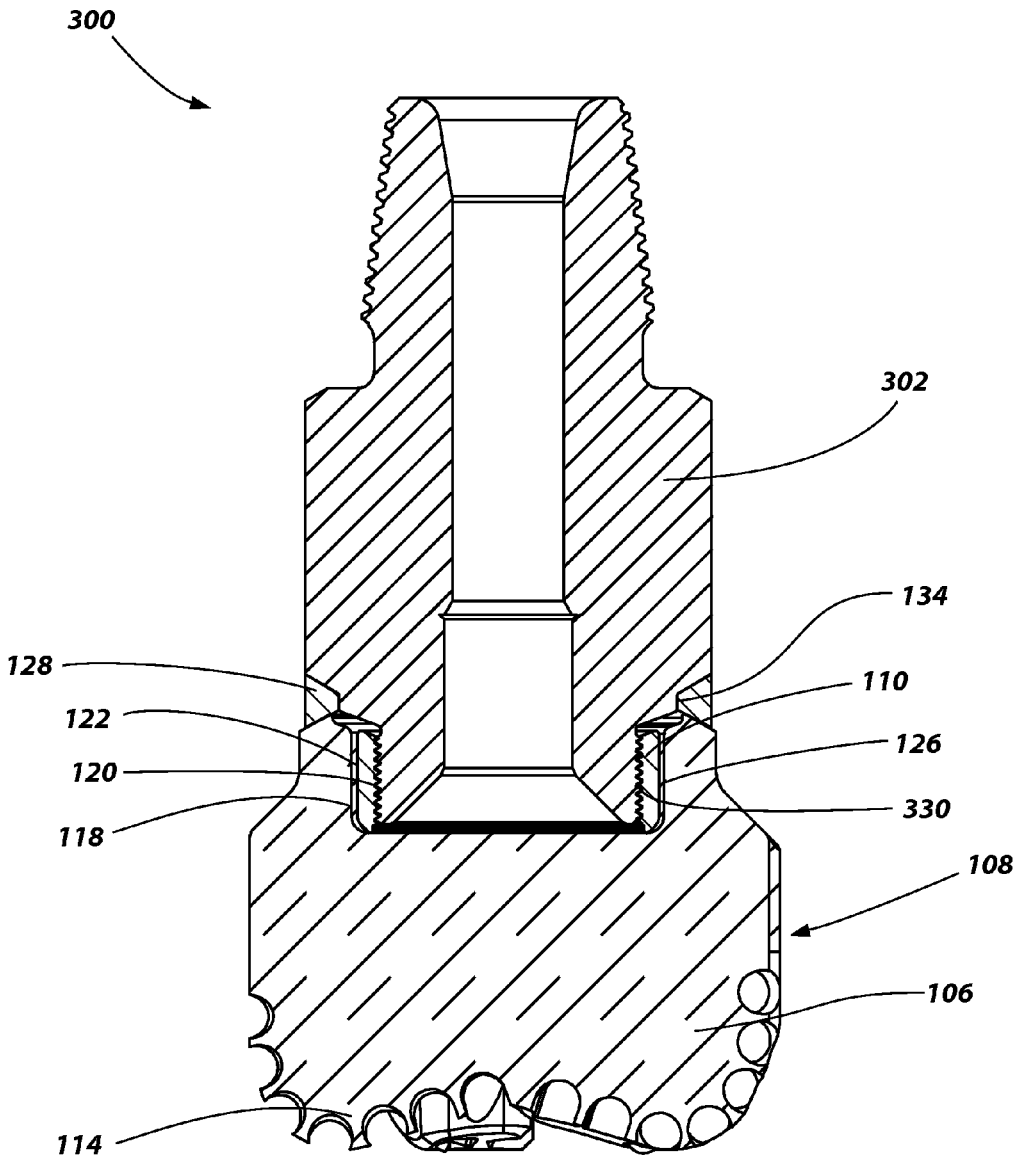
FIG. 7 is a longitudinal cross-sectional view of another embodiment of an earth-boring rotary drill bit of the present invention that includes a shank secured to a portion of a bit body of the drill bit using a threaded element.

For purposes of illustration, the thickness of the braze alloy 126 shown in FIGS. 4, 6, and 7 has been exaggerated. In actuality, the cylindrical surface 122 and the inner wall 124 on opposite sides of the braze alloy 126 may abut one another over substantially the entire area between the cylindrical surface 122 and the inner wall 124, as described herein, and any braze alloy 126 provided between abutting surfaces of the bit body 108 and the threaded element 110, such as the cylindrical surface 122 and the inner wall 124, may be substantially disposed in the relatively small gaps or spaces between the abutting surfaces that arise due to surface roughness or imperfections in or on the abutting surfaces. In some embodiments, the threaded element 110 and the cavity 118 may be sized and configured to create a gap having a predefined thickness between the threaded element 110 and the inner wall 124 of the bit body 108 within the cavity 118. As a non-limiting example, gap 125 may be formed having a predefined thickness measuring, for example, 25 to 200 microns (approximately 0.001 to 0.008 inch) between the surface 122 of the threaded element 110 and the inner wall 124 of the bit body 108 within the cavity 118. It is also contemplated that surface features, such as lands (e.g., bumps, ridges, protrusions, etc.), may be provided on one or both of the opposing and abutting surfaces for providing the gap 125 of predefined thickness between the opposing and abutting surfaces. Moreover, in some embodiments, discrete spacers may be used to provide the predefined gap 125. It is further contemplated that a surface feature, such as a groove may be provided on one or both of the opposing and abutting surfaces for defining an area between the surfaces for receiving an adhesive material therein, such as a braze alloy 126. A groove may allow for opposing surfaces of the threaded element 110 and the bit body 108 to be at least partially in direct contact, while providing an area for receiving an adhesive material therein.

In some embodiments, the threaded element 110 may comprise a material having a coefficient of thermal expansion that is at least substantially similar to the coefficient of thermal expansion of the bit body 108. As discussed above, the bit body 108 may comprise a particle-matrix composite material 106. The material of the threaded element 110 may have a substantially similar coefficient of thermal expansion to the particle-matrix composite material 106 that, for example, allows the threaded element 110 and the bit body 108 to expand and contract at substantially similar rates as the temperature of the threaded element 110 and the bit body 108 is varied. By way of example and not limitation, the material of threaded element 110 may comprise a material selected from tungsten-based alloys, iron-based alloys, nickel-based alloys, cobalt-based alloys, titanium-based alloys, aluminum-based alloys, iron and nickel-based alloys, iron and cobalt-based alloys, and nickel and cobalt-based alloys. The threaded element 110 may be selected from one of the alloys listed above that exhibits a coefficient of thermal expansion that is at least substantially similar to the coefficient of thermal expansion of the particle-matrix composite material 106 of the bit body 108. For example, the bit body 108 and the threaded element 110 may be exposed to elevated temperatures of approximately 400° C. or more during processes used to attach the threaded element 110 and the shank assembly 101 to the bit body 108. Moreover, a drill bit may also experience large temperature changes during the drilling process.

By way of example and not limitation, particle-matrix composite materials comprising particles or regions of tungsten carbide in an alloy matrix material may exhibit a linear coefficient of thermal expansion between about 4.0 μm/m° C. and about 10.0 μm/m° C., depending on the matrix alloy employed. For example, use of matrix alloys such as nickel-based and cobalt-based alloys, which exhibit a relatively lower linear coefficient of thermal expansion than other matrix alloys, may lower the overall linear coefficient of thermal expansion of the particle-matrix composite bit body. Thus, fabricating the threaded element 110 from a material exhibiting a linear coefficient of thermal expansion similar to the linear coefficient of thermal expansion of the conventional particle-matrix composite materials (i.e., between about 4.0 μm/m° C. and about 10.0 μm/m° C.) may allow the bit body 108 and the threaded element 110 to expand and contract at a similar rate during temperature changes. In some embodiments, the threaded element 110 may be formed from and comprise a material (e.g., a metal alloy) that exhibits a linear coefficient of thermal expansion within about 45% of a linear coefficient of thermal expansion exhibited by the material of the bit body 108, which may allow the bit body 108 and the threaded element 110 to expand and contract during temperature changes without significantly damaging the bit body 108 or the threaded element 110. For example, a threaded element made from a material such as a tungsten heavy alloy exhibiting a linear coefficient of thermal expansion of about 5.0 μm/m° C. may be selected for use with a particle-matrix bit body exhibiting a linear coefficient of thermal expansion of about 9.0 μm/m° C.

Referring again to FIG. 4, in the above described configuration, a surface of the shank assembly 101 such as a surface of the extension 104 includes an engagement feature such as a complementary threaded portion 130. The complementary threaded portion 130 is complementary to the threaded surface 120 of the threaded element 110. A mechanically interfering joint is provided to at least partially secure the shank assembly 101 to the bit body 108 when the threads of the threaded portion 130 of the extension 104 are engaged with the complementary threads of the threaded element 110. As used herein, the term "mechanical interference" means structural and physical interference between two or more components that hinders the separation of the two or more components. The forced separation of two or more components having mechanical interference therebetween results in macroscopic, physical deformation of at least a portion of at least one of the two or more components. The mechanical interference between the shank assembly 101 and the threaded element 110 within the cavity 118 of the bit body 108 may at least partially prevent or hinder relative longitudinal movement between the shank assembly 101 and the bit body 108 in directions parallel to the longitudinal axis of the drill bit 100. For example, any longitudinal force applied to the shank 102 by a drill string (not shown) during a drilling operation, or a substantial portion thereof, may be carried by the joint formed between the shank assembly 101 and the bit body 108. Additionally, a weld 128 that extends around at least a portion of the drill bit 100 on an exterior surface thereof along an interface between the bit body 108 and the shank assembly 101 (e.g., within the channel 134) may be used to at least partially secure the shank assembly 101 to the bit body 108.

As the joint may be configured such that mechanical interference between the shank assembly 101 and the bit body 108 carries at least a portion of the longitudinal forces or loads and/or any torsional forces or loads applied to the drill bit 100, the joint may be configured to reduce or prevent any longitudinal forces or loads and/or any torsional forces or loads from being applied to the weld 128 that also may be used to secure the shank assembly 101 to the bit body 108. As a result, the joint between the shank assembly 101 and the bit body 108 may prevent failure of the weld 128 between the bit body 108 and the shank assembly 101.

As shown in FIG. 6, in additional embodiments, a bit body 208 of an earth-boring rotary drill bit 200 may comprise a feature such as a protrusion 218. A shank assembly 201 and threaded element 210 may also have a complementary size and shape to the protrusion 218. The earth-boring rotary drill bit 200 is similar to the drill bit 100 shown in FIG. 4 and retains the same reference numerals for similar features. The threaded element 210, however, has a threaded outer surface 220.

The protrusion 218 may be fabricated such that the threaded element 210 may be at least partially disposed circumferentially about the protrusion 218. A surface, such as a generally smooth, non-threaded surface 222 located opposite to the threaded surface 220 of the threaded element 210 may be disposed proximate to (e.g., adjacent) an outer wall 224 of the protrusion 218. In some embodiments, a bonding material such as a braze alloy 126 may be provided between the threaded element 210 and the protrusion 218 to at least partially secure the threaded element 210 to the protrusion 218 of the bit body 208. The shank assembly 201 may include a complementary threaded surface, such as a threaded portion 230, formed on the extension 204. The protrusion 218 and the threaded element 210 may be partially received within the shank assembly 201. In addition to the braze alloy 126, a weld 128 extending around at least a portion of the drill bit 200 on an exterior surface thereof along an interface between the bit body 208 and the extension 204 (e.g., within the channel 134) may be used to at least partially secure the shank assembly 201 to the bit body 108.

While the embodiments of drill bits described hereinabove each include a shank assembly comprising a shank 102 secured to an extension 104, the present invention is not so limited. FIG. 7 is a longitudinal cross-sectional view of another embodiment of an earth-boring rotary drill bit 300 of the present invention. As shown therein, the shank assembly of the drill bit 300 comprises a shank 302 secured directly to the bit body 108 without using an extension therebetween. Like the previously described drill bits 100 and 200, the earth-boring rotary drill bit 300 shown in FIG. 7 does not include a metal blank, such as the steel blank 16 of the drill bit 10 (FIG. 1). The shank 302 is at least partially secured to the particle-matrix composite material 106 of a bit body 108 by use of a threaded element 110, such as a threaded insert configured to be inserted into a corresponding cavity in the bit body 108. Additionally, a weld 128 extending around at least a portion of the drill bit 300 on an exterior surface thereof along an interface between the bit body 108 and the shank 302 (e.g., within the channel 134) may be used to partially secure the shank 302 to the bit body 108.

The earth-boring rotary drill bit 300 is similar to the drill bit 100 shown in FIG. 4 and retains the same reference numerals for similar features. The shank 302 includes a threaded portion 330 complementary to the threaded element 110. In this configuration, a mechanically interfering joint is provided between the shank 302 and the bit body 108 by engaging the threads of the threaded portion 330 of the shank 302 with the complementary threads of the threaded element 110.

Referring again to FIG. 4, a method of assembling an earth-boring rotary drill bit as shown in the embodiments described above is now discussed. The method of assembling an earth-boring rotary drill bit 100 includes providing a bit body 108 (such as, for example, a pressed and sintered bit body) having at least one feature configured to receive the threaded element 110 having at least one threaded surface 120. As discussed above, so-called "pressed and sintered" bit bodies may be formed from and comprise a particle-matrix composite material. Examples of techniques that may be used to form pressed and sintered bit bodies are disclosed in U.S. patent application Ser. No. 11/272,439, filed Nov. 10, 2005, now U.S. Pat. No. 7,776,256, issued Aug. 17, 2010, by Smith et al., and in U.S. patent application Ser. No. 11/271,153, now U.S. Pat. No. 7,802,495, issued Sep. 28, 2010, by Oxford et al., also filed Nov. 10, 2005, the disclosure of each of which is also incorporated herein in its entirety by this reference.

By way of example and not limitation, the threaded surface 120 may be formed on a surface such as an inner surface 136 of the annular threaded element 110. The method may also include configuring the bit body 108 to receive the threaded element 110. For example, a cavity 118 may be formed in the bit body 108 to receive the threaded element 110. In some embodiments, the threaded element 210 may have the threaded surface 220 on the outer surface of the threaded element 210 and a bit body 208 may be provided with a protrusion 218 to receive to the threaded element 210, as shown in FIG. 6.

Referring again to FIG. 4, the threaded element 110 may be secured to the bit body 108 within the cavity 118 using a brazing process in which a molten metal alloy braze material may be drawn into the gap between the bit body 108 and the threaded element 110 due to capillary action, and allowed to cool and solidify therein. In some embodiments, the brazing process may include placing a braze alloy 126 into the gap 125 between the bit body 108 and the threaded element 110 before heating. The threaded element 110 may be sized and configured to provide the gap 125 between the threaded element 110 and the bit body 108 having a predefined thickness, as previously described herein.

In some embodiments, the material of the threaded element 110 may be selected so as to exhibit a coefficient of thermal expansion substantially similar to the coefficient of thermal expansion of the bit body 108.

A complementary threaded surface 130 of a shank assembly 101 (which may include a shank 102 and an extension 104 as described with reference to FIG. 4, or a shank 302 without an extension 104 as described with reference to FIG. 7) may be threaded onto the threaded element 110. The bit body 108 and the shank assembly 101 may also be welded at an interface, such as that within the channel 134, between a surface of the shank assembly 101 and a surface of the bit body 108.

Embodiments of the present invention may find particular utility in drill bits that comprise new particle-matrix composite materials and that are formed by pressing and sintering processes. New particle-matrix composite materials are currently being investigated in an effort to improve the performance and durability of earth-boring rotary drill bits. Examples of such new particle-matrix composite materials are disclosed in, for example, U.S. patent application Ser. No. 11/272,439, filed Nov. 10, 2005, now U.S. Pat. No. 7,776,256, issued Aug. 17, 2010, U.S. patent application Ser. No. 11/540,912, filed Sep. 29, 2006, now U.S. Pat. No. 7,913,779, issued Mar. 29, 2011, and U.S. patent application Ser. No. 11/593,437, filed Nov. 6, 2006, now U.S. Pat. No. 7,784,567, issued Aug. 31, 2010, the disclosure of each of which application is incorporated herein in its entirety by this reference.

Such new particle-matrix composite materials may include matrix materials that have a melting point relatively higher than the melting point of conventional matrix materials used in infiltration processes. By way of example and not limitation, nickel-based alloys, cobalt-based alloys, cobalt and nickel-based alloys, aluminum-based alloys, and titanium-based alloys are being considered for use as matrix materials in new particle-matrix composite materials. Such new matrix materials may have a melting point that is proximate to or higher than the melting points of metal alloys (e.g., steel alloys) conventionally used to form a metal blank, and/or they may be chemically incompatible with such metal alloys conventionally used to form a metal blank, such as the previously described steel blank 16 (FIG. 1).

Furthermore, bit bodies that comprise such new particle-matrix composite materials may be formed from methods other than the previously described infiltration processes. As discussed above, pressed and sintered bits are bit bodies that include such particle-matrix composite materials that may be faulted using powder compaction and sintering techniques. Such techniques may require sintering at temperatures proximate to or higher than the melting points of metal alloys (e.g., steel alloys) conventionally used to form a metal blank, such as the previously described steel blank 16 (FIG. 1). Moreover, once the bit body is sintered to obtain a fully dense bit body, the bit body is not easily machined and requires further processing which increases the cost of manufacturing.

In view of the above, it may be difficult or impossible to provide a metal blank in bit bodies formed from or comprising such new particle-matrix composite materials. As a result, it may be relatively difficult to attach a drill bit comprising a bit body formed from such new particle-matrix materials to a shank or other component of a drill string. Furthermore, because of the difference in melting temperatures and possible chemical incompatibility between a bit body formed from a new particle-matrix composite material and a shank formed from a metal alloy, welds as are conventionally used to secure the bit body to the shank may be difficult to form and may not exhibit the strength and durability of conventional welds. Conventional joints formed to secure a metal shank to a bit body may fail during drilling operations. Specifically, a joint securing a bit body to a metal shank may fail due to both a torque applied to the shank by a drill string or a drive shaft of a downhole motor during a drilling operation and longitudinal forces applied to the shank by a drill string during a drilling operation. Such longitudinal forces may include, for example, compressive forces applied to the shank during drilling and tensile forces applied to the shank while back reaming or tripping the drill bit from the wellbore. If a bit body becomes detached from a shank or drill string during drilling operations it can be difficult, time consuming, and expensive to remove or "fish" the bit body from the borehole.

Moreover, utilizing a joint securing the bit body to the shank assembly including a threaded element having a complementary coefficient of thermal expansion to the bit body may provide a connection with improved strength and durability. With substantially similar coefficients of thermal expansion, the bit body and the threaded element may expand and contract at a similar rate when exposed to differing thermal conditions such as a temperature change of approximately 400° C. A disparity in the coefficient of thermal expansion between the bit body and the threaded element may introduce significant residual stresses in the bit body, the threaded element, and in the adhesive material therebetween (e.g., a braze alloy). These stresses may lead to cracking and premature failure of the drill bit. Large temperature changes may also occur during the drilling process further subjecting the rotary drill bit to stresses caused by a coefficient of thermal expansion disparity. Thus, selecting a threaded element exhibiting a substantially similar coefficient of thermal expansion to the particle-matrix composite material of the bit body may serve to reduce the stresses introduced by temperature changes, and the performance of rotary drill bits comprising such bit bodies may be enhanced relative to heretofore known drill bits.

In view of the above, embodiments of the present invention may be particularly useful for forming joints between bit bodies formed from new particle-matrix composite materials and a shank formed from a metal.

In addition to shank assemblies, it is also difficult to attach nozzles to bit bodies formed from new particle-matrix composite materials.

Figure 8:
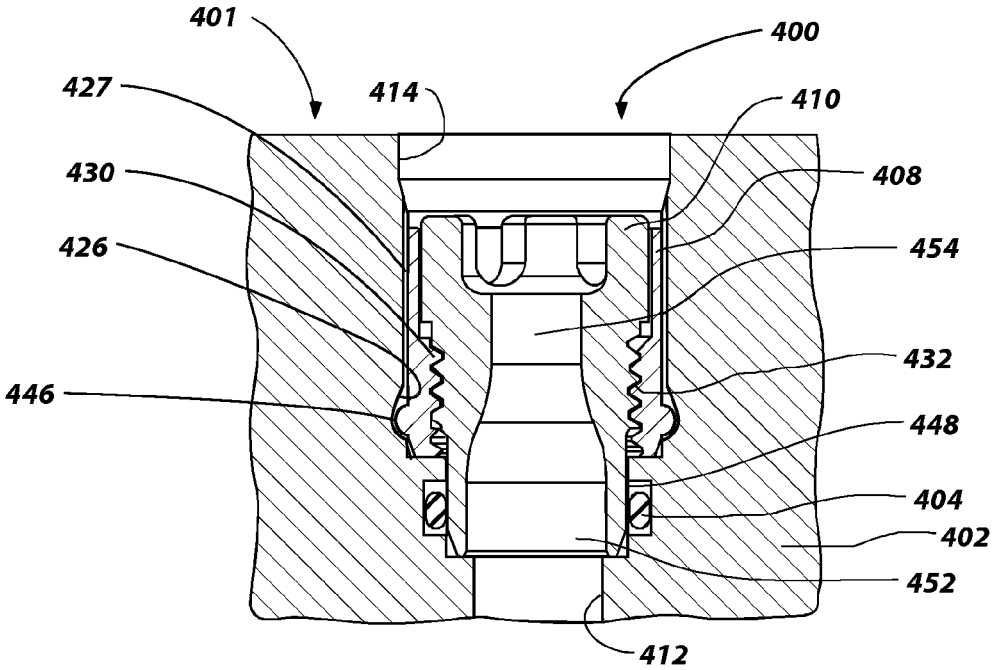
FIG. 8 is a cross-sectional view of a nozzle assembly in the drill bit shown in FIG. 3.
Figure 9:
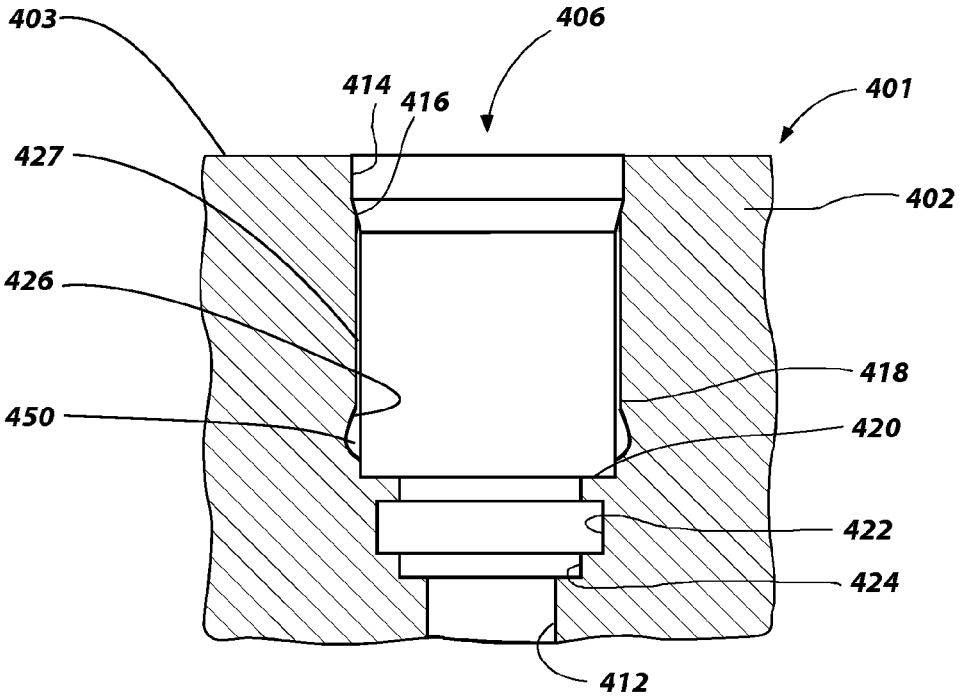
FIG. 9 is a cross-sectional view of a nozzle port in the drill bit shown in FIG. 8.

An embodiment of a nozzle assembly 400 of the present invention is shown in FIG. 3. It is noted that, while the nozzle assembly 400 is shown in conjunction with a drill bit as described herein above, the nozzle assembly 400 may be utilized in any earth-boring tool. Referring to FIGS. 8 and 9, the nozzle assembly 400 in this embodiment includes a substantially tubular sleeve 408, a nozzle 410, and a seal member 404 (e.g., an O-ring seal member 404) that may be received within a nozzle port 406 of a bit body 402. The nozzle port 406 comprises a socket that is defined by one or more substantially cylindrical internal surfaces of the bit body 402, and in which components of a nozzle assembly 400 are received. During drilling, drilling fluid may be caused to flow from a fluid passageway 412 within the bit body 402 to a face 403 of a drill bit 401 through the nozzle assembly 400. The sleeve 408, which comprises a substantially cylindrical external surface, is secured to the bit body 402 within the nozzle port 406 at least partially by mechanical interference between the sleeve 408 and the bit body 402, as described below.

Figure 10A:
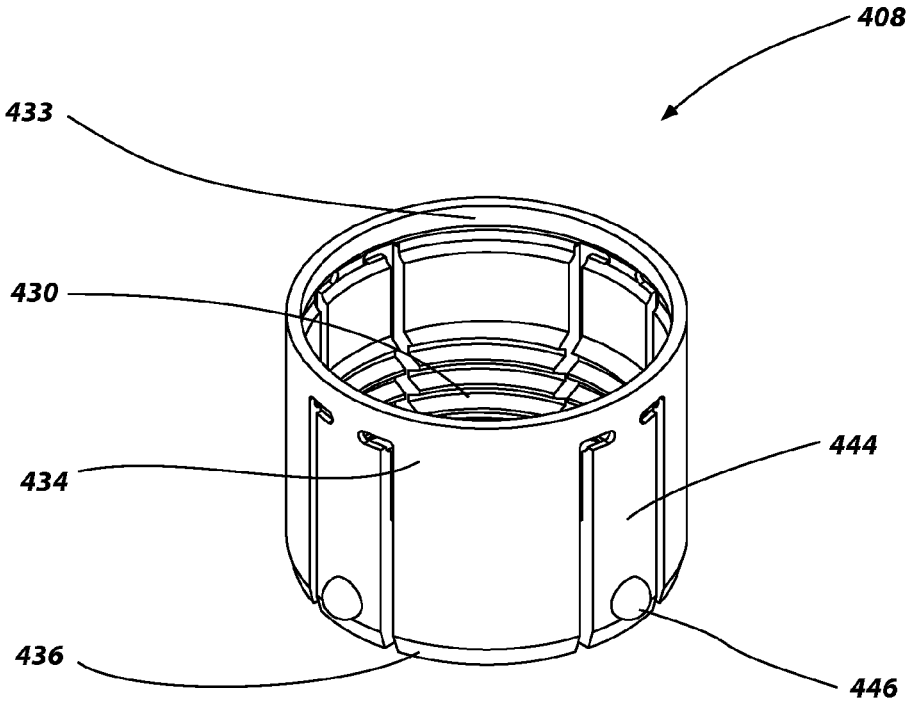
FIG. 10A is a perspective view of a sleeve as shown in FIG. 8.
Figure 10B:
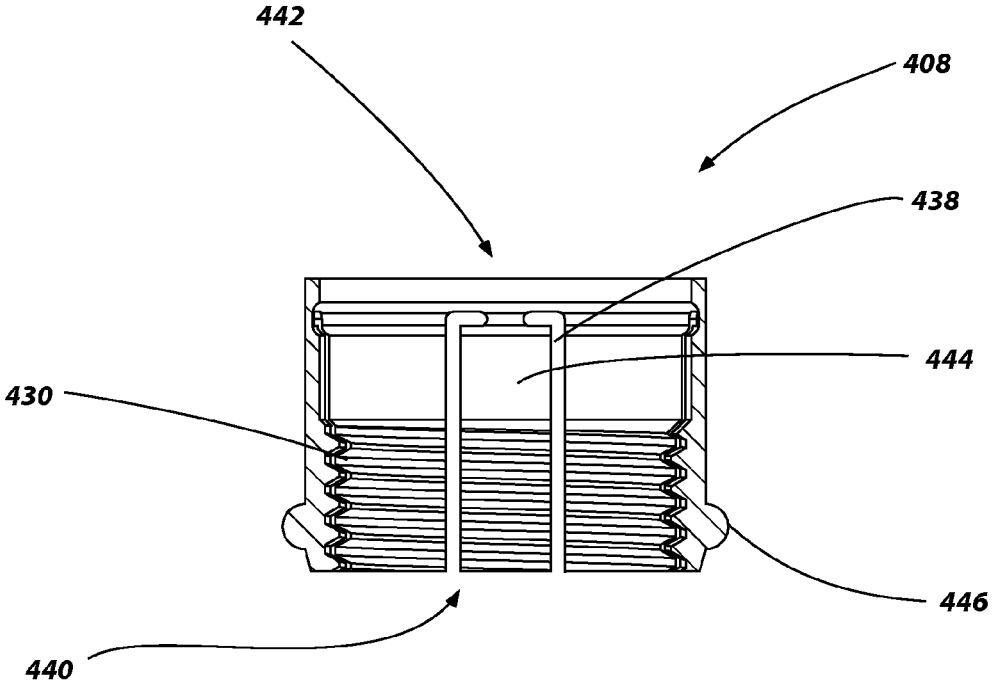
FIG. 10B is a cross-sectional view of the sleeve shown in FIG. 10A.

As shown in FIGS. 10A and 10B, the sleeve 408 may have a substantially cylindrical shape, and may have an inner surface 433 and an outer surface 434. The inner surface 433 of the sleeve 408 may be configured to receive a nozzle 410 (FIG. 8). In some embodiments, the inner surface 433 may have a threaded portion 430 comprising threads complementary to and configured to engage threads on the nozzle 410 (FIG. 8), as described in further detail below. In additional embodiments, the sleeve 408 and the nozzle 410 may have other complementary geometric configurations for retaining the nozzle 410 in the sleeve 408. The outer surface 434 of the sleeve 408 may also include an insertion chamfer 436 at one end thereof to facilitate insertion of the sleeve 408 into a sleeve pocket 418 of the nozzle port 406 (FIG. 9).

The sleeve 408 may be fabricated from a material or combination of materials such as, for example, a metal, a metal alloy (e.g., a high-strength steel alloy), or a polymer. In some embodiments, other materials may be used to form the sleeve 408, or to line (i.e., coat) the sleeve 408. Such materials may comprise, for example, ceramic materials or composite materials. The sleeve 408 may also include a plurality of flexible portions such as, for example, a plurality of flexible fingers 444, as shown in FIGS. 10A and 10B. In some embodiments, a plurality of slots 438 may be formed through the sleeve 408 to define the plurality of flexible fingers 444. The slots 438 may extend, for example, through a first longitudinal end 440 of the sleeve 408 toward a second longitudinal end 442 of the sleeve 408. The flexible fingers 444 may be flexible, for example, as compared to the remainder of the sleeve 408, due to their size and configuration. By way of example and not limitation, an amount of force such as 5-10 lbs. of force (approx. 20-45 Newton) may be adequate to flex the unsupported ends of the flexible fingers 444 in a radially outward direction by a few millimeters or more.

The flexibility of the flexible fingers 444 (i.e., the amount of force required to cause the unsupported ends of the flexible fingers 444 to flex in the radially outward direction by a given distance) may be partially a function of the distance that the slots 438 extend through the sleeve 408 (and, hence, the length of the flexible fingers 444). As shown in FIGS. 10A and 10B, the slots 438 may also extend in a direction at an angle (i.e., a 90 degree angle) to the longitudinal axis of the sleeve 408 to impart additional flexibility to the flexible fingers 444.

The flexible fingers 444 may also include protrusions 446 formed on the outer surfaces 434 of the sleeve 408 on the unsupported ends of the fingers 444. In some embodiments, the protrusions 446 may comprise discrete protrusions 446 formed separate from the flexible fingers 444 and disposed thereon or secured thereto. For example, a spherical ball may be affixed to a flexible finger 444 partially within a hemispherical recess formed in a surface of the flexible fingers 444. It is noted that while the protrusions 446 shown in FIGS. 8, 10A, and 10B have a semispherical shape, in additional embodiments, the protrusions 446 may have any shape that can be used to provide mechanical interference between the sleeve 408 and the bit body 402 when the nozzle assembly 400 is secured within the bit body 402, as shown in FIG. 8. Furthermore, in yet other embodiments such as the embodiment shown in FIG. 11 and described below in further detail, the outer surface 434 of the sleeve 408 on the fingers 444 may be tapered (i.e., the outer surface 434 may extend at an acute angle to a longitudinal axis of the sleeve 408).

Referring again to FIG. 9, the nozzle port 406 formed in the bit body 402 of the drill bit 401 is configured for receiving the nozzle assembly 400 therein and may include, for example, an exit port 414, a fluid passageway 412, a sleeve pocket 418, a sleeve seat 420, a seal groove 422, and a nozzle body port 424. The exit port 414 may be configured to be slightly larger than the sleeve pocket 418 to facilitate insertion of the sleeve 408 into the nozzle port 406. Further, a chamfer 416 on the sleeve 408 facilitates alignment and placement of the sleeve 408 as it is inserted into the sleeve pocket 418. The sleeve seat 420 comprises a surface against which an end of the sleeve 408 abuts when the sleeve 408 is fully inserted into the nozzle port 406. The nozzle body port 424 may comprise a circumferentially extending seal groove 422 formed into the bit body 402 that is configured to receive a seal member 404 (e.g., an O-ring) therein. The seal member 404 may provide a fluid barrier as it is compressed between the nozzle 410 and the nozzle port 406 to reduce or prevent the flow of drilling fluid around the exterior of the sleeve 408 and erosion that might result therefrom.

In some embodiments, the nozzle port 406 may comprise at least one feature, such as a plurality of recesses 426 (or a single recess), that are formed in the nozzle port 406, and that are complementary to the protrusions 446. The recesses 426 may be used to mechanically retain the sleeve 408 within the nozzle port 406 by mechanical interference when the protrusions 446 formed on the sleeve 408 are disposed within the recesses 426, as discussed above in reference to FIGS. 10A and 10B. As shown in FIG. 9, the recesses 426 may be formed in the nozzle port 406 to at least partially receive the protrusions 446. By way of example and not limitation, the recesses 426 shown in FIG. 9 may be formed to have a shape that is generally complementary to the protrusions 446 shown in FIGS. 10A and 10B. However, the complementary feature need not be formed in a shape only complementary to the protrusions 446 of the sleeve 408. The complementary portion may be formed in any shape that may receive the shape of the protrusions 446 therein. For example, a substantially tapered surface or a single annular groove extending circumferentially around the nozzle port 406 may be formed in the bit body and configured to interact with the protrusions 446 in such a manner as to provide mechanical interference therebetween when the nozzle assembly 400 is secured within the bit body 402. It is also contemplated that the nozzle port 406 may not contain a complementary feature to the protrusions 446.

In some embodiments, longitudinally extending grooves 427 may be formed in the surface of the bit body 402 within the nozzle port 406. Each longitudinal groove 427 may extend in a direction parallel to the longitudinal axis of the nozzle port 406, and may be aligned with, and extend to, a recess 426. The grooves 427 may provide a minimal relief in which the protrusions 446 may be disposed to facilitate insertion of the sleeve 408 into the nozzle port 406.

Referring again to FIG. 8, the sleeve 408 is shown disposed in the nozzle port 406 and the protrusions 446 formed on the flexible fingers 444 are disposed in the recesses 426. The flexible fingers 444 may bias the protrusions 446 of the sleeve 408 into the recesses 426 of the nozzle port 406. When the protrusions 446 are at least partially disposed in the recesses 426, the sleeve 408 may be retained in the nozzle port 406 by mechanical interference between the protrusions 446 and the surfaces of the bit body 402 defining the recesses 426. In embodiments in which the flexible fingers 444 do not include protrusions 446, the flexible fingers 444 may merely bias a portion of the outer surfaces 434 on the fingers 444 into contact with the surfaces of the bit body 402 defining the nozzle port 406.

The nozzle 410 may include an outer wall 448, a threaded connection portion 432, and an internal passageway or bore 452 through which drilling fluid flows from fluid passageway 412 to a nozzle orifice 454. The nozzle 410 is removably insertable into the sleeve 408 in a coaxially engaging relationship therewith and may be interferingly engaged with the nozzle port 406 by complementary connection portions formed on the nozzle 410 and the sleeve 408. For example, the sleeve 408 may comprise a threaded portion 430 having threads that are complementary to threads on a threaded portion 432 of the nozzle 410. Thus, the nozzle 410 can be threaded into the sleeve 408. When the nozzle 410 is threaded into the sleeve 408, the nozzle 410 acts to secure the sleeve 408 within the nozzle port 406 of the bit body 402 by preventing the fingers 444 from deflecting or bending in any way that would allow the protrusions 446 to be removed from within the recesses 426. In other words, as shown in FIG. 8, the nozzle 410 prevents the flexible fingers 444 from flexing radially inward while the nozzle 410 is disposed in the nozzle port 406.

The nozzle port 406 may also include a seal member 404 that is sized and configured to be compressed between the outer wall of the seal groove 422 of the body nozzle port 424 and the outer wall 448 of the nozzle 410 to substantially prevent drilling fluid flow between the sleeve 408 and the nozzle port 406, while the fluid flows through the nozzle assembly 400. In some embodiments, fluid sealing may be provided between the nozzle 410 and the wall of nozzle port 406 below the engaged threaded portions 430 and 432. However, the seal member 404 may be provided elsewhere along the outer wall 448 of nozzle 410 and wall of the nozzle port 406, between the sleeve 408 and the nozzle port 406 and/or between the sleeve 408 and the outer wall 448 of the nozzle 410. In this regard, additional seals may also be utilized to advantage as described in U.S. patent application Ser. No. 11/600,304, which was filed Nov. 15, 2006, now U.S. Pat. No. 7,954,568, issued Jun. 7, 2011 and entitled "Drill Bit Nozzle Assembly, Insert Assembly Including Same and Method of Manufacturing or Retrofitting a Steel Body Bit for Use With the Insert Assembly," which is incorporated herein in its entirety by this reference, and may be utilized in embodiments of the invention.

The nozzle 410 may comprise a relatively erosion-resistant material, such as, for example, cemented tungsten carbide material, to provide relatively high resistance to erosion that might result from drilling fluid being pumped through the nozzle assembly 400. Optionally, other materials may be used to form the nozzle 410, or to coat the nozzle 410, such as other particle-matrix composite materials, steels, or ceramic materials. Moreover, other particle-matrix composite materials, such as, for example, materials that include particles of tungsten carbide or titanium carbide embedded in a metal alloy matrix such as cobalt-based alloy, a nickel-based alloy, or a steel-based alloy may also be selected as a material for components of the nozzle assembly 400 including the sleeve 408 and the nozzle 410.

In some embodiments, the sleeve 408 may comprise an iron-based alloy (e.g., a steel alloy), the nozzle 410 may comprise a cemented carbide material (e.g., cobalt-cemented tungsten carbide), and the bit body 402 may comprise a particle-matrix composite material (e.g., cobalt-cemented tungsten carbide). By using the sleeve 408 in accordance with embodiments of the present invention, the sleeve 408 may be removed and repaired or replaced without alteration to the bit body 402.

The seal groove 422 in FIG. 9 is shown as an open, annular channel of substantially rectangular cross section. However, the seal groove 422 may have any suitable cross-sectional shape. The effectiveness of seal groove 422 may be less affected by dimensional changes caused in the bit body 402 during final sintering because the seal member 404 may adequately compensate for such changes by accommodating the resulting structure. While the seal groove 422 is shown completely located within the material of the bit body 402 surrounding the nozzle port 406, it may optionally be located in the outer wall 448 of the nozzle 410 and/or the outer surface 434 of the sleeve 408. The seal groove 422 may also be optionally formed partially within the material of the bit body 402 surrounding the nozzle port 406 and partially within the outer wall 448 of the nozzle 410 or the outer surface 434 of the sleeve 408, respectively, depending upon the type of seal used. Also, additional seal grooves and seals may optionally be used as desirable.

The seal member 404 prevents drilling fluid from bypassing the interior of the sleeve 408 and flowing through any gaps at locations between components to eliminate the potential for erosion while avoiding the need for the use of joint compound, particularly between the threads. The seal member 404 may comprise an elastomer or another resilient seal material or combination of materials configured for sealing, when compressed, under high pressure within the anticipated temperature range and under anticipated environmental conditions (e.g., carbon dioxide, sour gas, etc.) to which drill bit 401 may be exposed for the particular application. Seal design is well known to persons having ordinary skill in the art; therefore, a suitable seal material, size and configuration may easily be determined, and many seal designs will be equally acceptable for a variety of conditions. For example, without limitation, instead of an O-ring seal, a spring-energized seal or a pressure energized seal may be employed. Further, the seal material may be designed to withstand high or low temperatures expected during the assembly process of a sleeve into a bit body and temperature conditions encountered during a drilling operation.

In some embodiments, the sleeve 408 may be at least partially secured within the nozzle port 406 using, for example, bonding techniques such as adhesives, soldering, brazing, and welding. When the sleeve is secured by bonding within the bit body, the bond must be able to withstand continuous operating conditions typically encountered that include high pressure, pulsating pressure and temperature changes.

Figure 11:
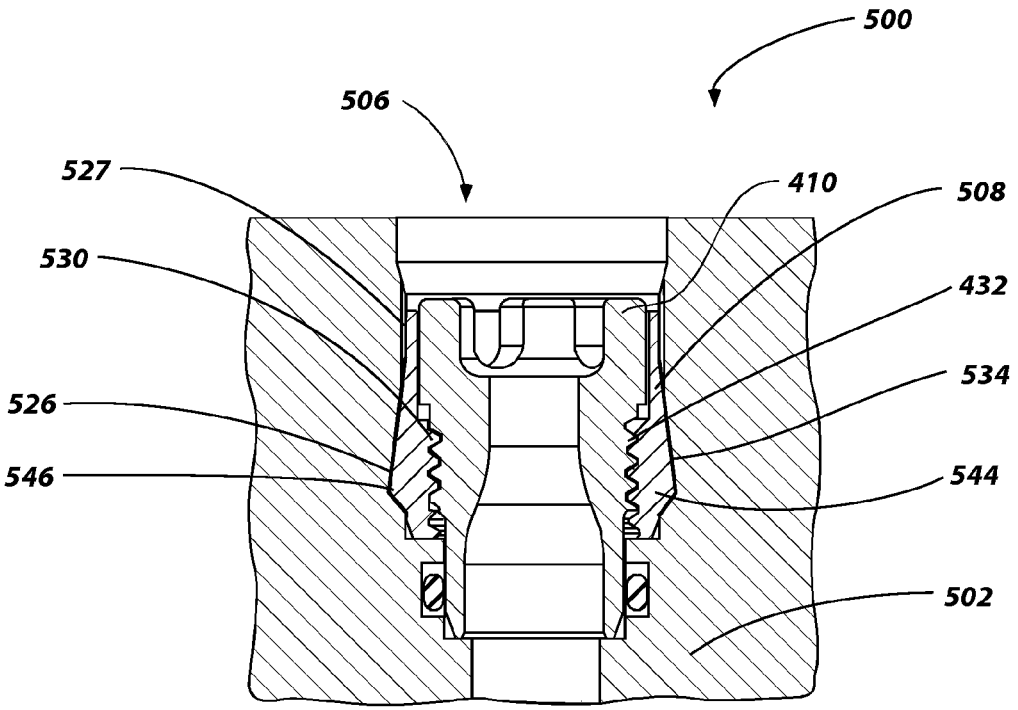
FIG. 11 is a cross-sectional view of another embodiment of a nozzle assembly of the present invention.

Referring briefly to FIG. 11, in additional embodiments, the nozzle assembly 500 may include a sleeve 508 having flexible fingers 544 with a feature such as a tapered surface 546 (i.e., the outer surface 534 may extend at an acute angle to a longitudinal axis of the sleeve 508). The nozzle assembly 500 is similar to the nozzle assembly 400 shown in FIG. 8 and retains the same reference numerals for similar features. The sleeve 508, however, includes tapered surfaces 546.

The sleeve 508 is shown disposed in the nozzle port 506 and the tapered surfaces 546 formed on the flexible fingers 544 are disposed in recesses 526 formed in nozzle port 506 of the bit body 502. Similar to previous embodiments, longitudinally extending grooves 527 may be formed in the surface of the bit body 502 within the nozzle port 506. The flexible fingers 544 may bias the tapered surfaces 546 of the sleeve 508 into the recesses 526 of the nozzle port 506. When the tapered surfaces 546 are at least partially disposed in the recesses 526, the sleeve 508 may be retained in the nozzle port 506 by mechanical interference between the protrusions 546 and the surfaces of the bit body 502 defining the recesses 526. The nozzle 410 is removably insertable into the sleeve 508 in a coaxially engaging relationship therewith and may be interferingly engaged with the nozzle port 506 by complementary connection portions 432 formed on the nozzle 410 and the sleeve 508. For example, the sleeve 508 may comprise a threaded portion 530 having threads that are complementary to threads on a threaded portion 432 of the nozzle 410. Thus, the nozzle 410 can be threaded into the sleeve 508. When the nozzle 410 is threaded into the sleeve 508, the nozzle 410 acts to secure the sleeve 508 within the nozzle port 506 of the bit body 502 by preventing the fingers 544 from deflecting or bending in any way that would allow the tapered surfaces 546 to be removed from within the recesses 526.

A method of manufacturing or retrofitting a drill bit for mechanically retaining a nozzle assembly 400 as shown in the previously described embodiments is now discussed. Referring again to FIG. 8, the method of manufacturing or retrofitting a drill bit includes providing a nozzle port 406 in a bit body 402 and forming a complementary portion such as a recess 426 in the nozzle port 406. By way of example and not limitation, a nozzle port 406 and complementary features such as a recess 426 may be formed in a bit body 402 such as, for example, a particle-matrix composite material. By way of example and not limitation, the nozzle port 406 may be formed in a pressed and sintered bit body by a pre-machining process while the bit body 402 is in a less than fully sintered state (e.g., a green state or a brown state). Displacements, as known to those of ordinary skill in the art, may be utilized during sintering to control the shrinkage and prevent or reduce warpage or distortion of features formed into the less than fully sintered body. After the body is sintered to a desirable final density, a post-sintering machining process (e.g., grinding or milling) may be used, if necessary or desirable, to obtain the final shape and dimensions of a nozzle port 406 and complementary features. A sleeve, such as the previously described tubular sleeve 408, may be inserted into the nozzle port 406. As previously discussed, a plurality of flexible portions such as flexible fingers 444 may be formed in the sleeve 408. The flexible portions such as the flexible fingers 444 may be defined in the sleeve 408 by forming a plurality of slots 438 through the sleeve 408 extending from a first longitudinal end 440 toward a second longitudinal end 442 of the sleeve 408. As shown in FIG. 8, each of the slots 438 defines a lateral side of at least one of the flexible fingers 444.

The method may further include forming a plurality of protrusions 446 on an outer wall 448 of the sleeve 408. Forming the protrusions 446 may comprise discrete semicircular protrusions 446 as shown in FIG. 8. However, the protrusions 446 may be any suitable shape, including forming the protrusions 446 to comprise a tapered surface on the outer surface 434 of the flexible fingers 444. In some embodiments, forming the complementary portion of the nozzle port 406 such as the recesses 426 may include forming a receiving portion 450 of the recesses 426 to receive at least one of the plurality of protrusions 446. As discussed above, the protrusions 446 may comprise any suitable shape to retain the sleeve 408 within the nozzle port 406. Retaining the sleeve 408 in the bit body 402 may be accomplished by interferingly engaging the protrusions 446 with the recesses 426. For example, during insertion of the sleeve 408, the flexible fingers 444 may be inwardly flexed to allow the insertion of the sleeve 408 into the nozzle port 406. As the sleeve 408 is inserted, the flexible fingers 444 may relax from the inwardly flexed position and may, for example, bias the protrusions 446 of the sleeve 408 into the recesses 426 of the nozzle port 406. Moreover, grooves 427, as previously described herein, may also be formed to extend along a longitudinal axis of the nozzle port 406 from the receiving portion 450 toward an exterior surface such as the face 403 of the bit body 402. Similarly, the recesses 426 may be any shape suitable to receive the protrusions 446 of the sleeve 408, including a tapered surface formed in the sleeve pocket 418. The grooves 427 may guide the protrusions 446 into the recesses 426 as the sleeve 408 is inserted into the nozzle port 406. The sleeve 408 may also be formed to include a connection portion such as the threaded portion 430 shown in FIGS. 10A and 10B.

Referring again to FIG. 8, the method of manufacturing or retrofitting a drill bit may further include providing a nozzle 410 disposed in the nozzle port 406. In some embodiments, a complementary threaded portion 432 may be provided on the nozzle 410 and the nozzle 410 may be threaded onto the threaded portion 430 of the sleeve 408. Threading the nozzle 410 into the sleeve 408 may also secure a portion of at least one of the flexible fingers 444 with the complementary portion of the nozzle port 406, such as the recesses 426.

The components and methods for manufacturing or retrofitting a drill bit and a nozzle assembly of the present invention may also find particular utility in drill bits having bit bodies that comprise new particle-matrix composite materials and that are formed by pressing and sintering processes, as it may be difficult or impossible to form threads directly in such bit bodies.

Accordingly, some embodiments of the present invention provide for the attachment of a nozzle in which the tolerances may be obtained regardless of the material selected for the body of the drill bit. The present invention also provides an attachment that is achievable after the bit body is substantially manufactured which may be desirable for bit bodies fabricated from particle-matrix composite materials and bit bodies manufactured by sintering or infiltration processes.

Embodiments of nozzle assemblies of the present invention may be utilized with new drill bits, or they may be used to repair used drill bits for further use in the field. Use of a nozzle assembly with a drill bit as described herein enables removal and installation of standardized nozzles in the field, and may reduce unwanted washout or erosion of the nozzle assembly. Utilizing embodiments of nozzle assemblies as described herein, the sleeve, nozzle, inlet tube, and O-ring seals or other seals may be replaced as necessary or desirable, as in the case wherein a nozzle may be changed out for one with a different orifice size or configuration.

According to embodiments of the invention, providing a nozzle port in a bit body may be accomplished by machining the nozzle port in the bit body. For example, if the bit body is manufactured from a steel billet, the nozzle port may be easily machined to size and configured for compressively receiving a sleeve. As another example, if the bit body is manufactured in the form of a sintering process, the nozzle port may be machined into the "brown" or "green" body prior to final sintering, and after final sintering, the sleeve may be inserted into the nozzle port, as mentioned above.

The advantages of the invention mentioned herein for pressed and sintered bit bodies may apply similarly to infiltrated bits. Steel body bits, again as noted above, comprise steel bodies generally machined from bars or castings, and may also be machined from forgings. While steel body bits are not subjected to the same manufacturing sensitivities as noted above, steel body bits may enjoy the advantages of the invention obtained during manufacture, assembly or retrofitting as described herein.

Embodiments of the present invention include, without limitation, core bits, bi-center bits, eccentric bits, so-called "reamer wings" as well as drilling and other downhole tools that may employ a body having a shank, nozzle, or another component secured thereto in accordance with methods described herein. Therefore, as used herein, the terms "earth-boring drill bit" and "drill bit" encompass all such structures.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors.

What is claimed is:

1. A nozzle assembly for a drill bit for subterranean drilling, the nozzle assembly comprising:

a cylindrical sleeve having a threaded inner surface, an outer surface, a first longitudinal end, and a second, opposite longitudinal end, the cylindrical sleeve comprising:

a plurality of slots extending from the first longitudinal end toward the second longitudinal end and defining a plurality of flexible fingers therebetween, and a plurality of protrusions, each protrusion disposed on an outer surface of a flexible finger of the plurality of flexible fingers; and a nozzle having a threaded outer surface configured to engage the threaded inner surface of the cylindrical sleeve.

2. An earth-boring drill bit, comprising:

a bit body having at least one nozzle port and at least one recess within the at least one nozzle port;

a substantially cylindrical sleeve disposed within the at least one nozzle port, the sleeve having an inner surface, an outer surface, a first longitudinal end, and a second, opposite longitudinal end, the cylindrical sleeve comprising a plurality of slots extending from the first longitudinal end toward the second longitudinal end and defining a plurality of flexible fingers therebetween, wherein at least one feature on an outer surface of at least one finger of the plurality of flexible fingers is disposed at least partially within the at least one recess, mechanical interference between the at least one feature on the outer surface of the at least one finger and a surface of the bit body defining the at least one recess securing the sleeve within the at least one nozzle port of the bit body; and a nozzle disposed at least partially within the cylindrical sleeve, the nozzle having an outer surface engaged with the inner surface of the cylindrical sleeve.

3. The drill bit of claim 2, wherein the at least one feature comprises a tapered surface formed on the outer surface of at least one finger of the plurality of flexible fingers and wherein the surface of the bit body defining the at least one recess comprises a complementary tapered surface.

4. The drill bit of claim 2, wherein each flexible finger of the plurality of flexible fingers is configured to flex in a radially inward direction of the cylindrical sleeve.

5. The drill bit of claim 2, wherein the cylindrical sleeve further comprises a plurality of protrusions, each protrusion disposed on an outer surface of a flexible finger of the plurality of flexible fingers and engaged with the at least one recess of the at least one nozzle port of the bit body.

6. The drill bit of claim 2, wherein at least a portion of each flexible finger of the plurality of flexible fingers is engaged with an inner surface of the at least one nozzle port of the bit body.

7. The drill bit of claim 6, wherein the nozzle secures the cylindrical sleeve within the at least one nozzle port of the bit body by preventing the at least a portion of each flexible finger of the plurality of flexible fingers from disengaging with the inner surface of the bit body.

8. The drill bit of claim 6, wherein the plurality of flexible fingers are biased into contact with the inner surface of the at least one nozzle port of the bit body.

9. The drill bit of claim 2, wherein the at least one nozzle port of the bit body comprises a plurality of nozzle ports, each nozzle port having a substantially cylindrical sleeve disposed therein and a nozzle disposed at least partially within the cylindrical sleeve.

10. The drill bit of claim 2, wherein the second longitudinal end of the cylindrical sleeve is positioned proximate an outer surface of the bit body and proximate an output end of the nozzle.

11. The drill bit of claim 2, wherein the nozzle comprises a threaded outer surface engaged with a threaded inner surface of the cylindrical sleeve.

12. An earth-boring drill bit, comprising:

a bit body comprising:

at least one nozzle port; and at least one body feature within the at least one nozzle port;

a sleeve disposed within the at least one nozzle port, the sleeve having an inner surface, an outer surface, a first longitudinal end, and a second, opposite longitudinal end, the sleeve comprising a plurality of slots extending from the first longitudinal end toward the second longitudinal end and defining a plurality of flexible fingers therebetween, wherein at least one sleeve feature on an outer surface of at least one finger of the plurality of flexible fingers is complementary to the at least one body feature within the at least one nozzle port, wherein mechanical interference between the at least one sleeve feature on the outer surface of the at least one finger and the at least one body feature securing the sleeve within the at least one nozzle port of the bit body; and a nozzle disposed at least partially within the sleeve, the nozzle having an outer surface engaged with the inner surface of the sleeve.

13. The drill bit of claim 12, wherein the at least one sleeve feature comprises at least one protrusion disposed on the outer surface of at least one finger of the plurality of flexible fingers.

14. The drill bit of claim 13, wherein the at least one body feature of the bit body comprises at least one recess that is complementary to the at least one protrusion.

15. The drill bit of claim 12, wherein the at least one sleeve feature comprises a tapered surface formed on the outer surface of at least one finger of the plurality of flexible fingers and wherein the at least one body feature comprises a complementary tapered surface.

16. The drill bit of claim 12, wherein each flexible finger of the plurality of flexible fingers is configured to flex in a radially inward direction of the sleeve.

17. An earth-boring drill bit, comprising:

a bit body comprising:

at least one nozzle port; and at least one body feature within the at least one nozzle port;

a sleeve disposed within the at least one nozzle port, the sleeve having an inner surface, an outer surface, a first longitudinal end, and a second, opposite longitudinal end, the sleeve comprising a plurality of slots extending to the second longitudinal end and defining a plurality of flexible fingers at the second longitudinal end, wherein the sleeve is disposed within the at least one nozzle port of the bit body with the first longitudinal end at an outer surface of the bit body and the second longitudinal end within the at least one nozzle port of the bit body; and a nozzle disposed at least partially within the sleeve, the nozzle having an outer surface engaged with the inner surface of the sleeve.

* * * * *